US010010465B2

(12) United States Patent
Sálus

(10) Patent No.: US 10,010,465 B2
(45) Date of Patent: Jul. 3, 2018

(54) BED GUARD ASSEMBLY

(71) Applicant: LINET SPOL. S.R.O., Slany (CZ)

(72) Inventor: Michal Sálus, Roudnice nad Labem (CZ)

(73) Assignee: Linet spol S.R.O., Slany (CZ)

( * ) Notice: Subject to any disclaimer, the term of this patent is extended or adjusted under 35 U.S.C. 154(b) by 166 days.

(21) Appl. No.: 14/917,273

(22) PCT Filed: Sep. 17, 2014

(86) PCT No.: PCT/CZ2014/000102
§ 371 (c)(1),
(2) Date: Mar. 8, 2016

(87) PCT Pub. No.: WO2015/039637
PCT Pub. Date: Mar. 26, 2015

(65) Prior Publication Data

US 2016/0213538 A1 Jul. 28, 2016

(30) Foreign Application Priority Data

Sep. 17, 2013 (CZ) ..... PV 2013-710

(51) Int. Cl.
*A61G 7/05* (2006.01)
*A47C 21/08* (2006.01)
*A61G 7/012* (2006.01)

(52) U.S. Cl.
CPC ..... *A61G 7/0507* (2013.01); *A47C 21/08* (2013.01); *A61G 7/0508* (2016.11);
(Continued)

(58) Field of Classification Search
CPC ..... A61G 7/05; A61G 7/0507; A61G 7/0508; A61G 7/0518; A61G 7/053; A47C 21/00; A47C 21/08
(Continued)

(56) References Cited

U.S. PATENT DOCUMENTS 2,929,078 A 3/1960 Smith et al.
4,724,559 A 2/1988 Bly et al.
(Continued)

FOREIGN PATENT DOCUMENTS

DE 20 2006 002334 U1 4/2006
ES 2 187 345 A1 6/2003
FR 2 974 989 A1 11/2012

OTHER PUBLICATIONS

WIPO, International Search Report, completed Dec. 22, 2014, in International Patent Application No. PCT/CZ2014/000102, filed on Sep. 17, 2014.
(Continued)

*Primary Examiner* — Robert G Santos
(74) *Attorney, Agent, or Firm* — Thedford I. Hitaffer; Hitaffer & Hitaffer, PLLC

(57) ABSTRACT

The bed consists of a frame, mattress platform and removable bed guard assembly. The bed guard assembly includes a main support which at the lower end has a mounting for connection to the bed, a guard permanently fixed to the main support and a locking mechanism for fixing the main support in relation to the bed. The locking mechanism is located inside the guard assembly and includes a sleeve and blocking element which moves between two positions. In one position the blocking element engages in the sleeve, and in the second position the blocking element is released from the sleeve, where in one of these positions it allows the movement of the main support in relation to the sleeve, and in the second of these positions it prevents the movement of the main support in relation to the sleeve, the movement of the blocking element of the locking mechanism is controlled by the actuator.

13 Claims, 10 Drawing Sheets

(52) U.S. Cl.
CPC ..... *A61G 7/0509* (2016.11); *A61G 7/0513* (2016.11); *A61G 7/0518* (2016.11); *A61G 7/012* (2013.01); *A61G 7/0506* (2013.01)

(58) Field of Classification Search
USPC ..... 5/428, 425, 424, 662, 658
See application file for complete search history.

(56) References Cited

U.S. PATENT DOCUMENTS 5,038,430 A * 8/1991 Bly ..... A47C 21/08
403/397
2016/0213538 A1* 7/2016 S Lus ..... A61G 7/0507

OTHER PUBLICATIONS

WIPO, Written Opinion of the International Searching Authority, dated Dec. 22, 2014, in International Patent Application No. PCT/CZ2014/000102, filed on Sep. 17, 2014.

* cited by examiner

BED GUARD ASSEMBLY

TECHNICAL FIELD

The invention is related to a guard for a hospital bed preventing the patient falling out of bed. This guard is connected to the frame of the hospital bed and is removable. This guard is used in an addition to the standard side rails of a hospital bed.

BACKGROUND ART

Several types of guards are used to prevent a patient falling out of bed. The patient is prevented from falling off the patient support of the bed either by several side rails cooperating together or by a single side rail protecting the majority of the side of the patient support. These side rails are permanently fixed to the bed in such a way that they are able to collapse down and thus the patient is able to leave the bed or the medical personnel is afforded better access to the patient and simpler handling with the patient.

Several mechanisms are used for locking the guard. Most of these mechanisms are permanently attached to the side rail, which is permanently attached to the bed in such a way that it can move between the collapsed and raised position. These positions are achieved by a combination of horizontal and vertical movements. Another disadvantage of currently used mechanisms is the insufficient protection against movement of the guard. Most used solutions contain only one safety element, which in some cases could be overcome by an unintentional movement.

The locking of the guard via a lever mechanism is described in CN201905562U, where the unlocking of the guard is realized by a movement of the lever mechanism which lifts the entire body of the guard in relation to the side rail. The guard can then be rotated around an axis located in the side rail. This solution overcomes the problem of spontaneous unlocking of the guard because unlocking of the guard is achieved by a vertical movement of the lever.

The guard described in JP2004357875A is equipped with another locking system, but in this case spontaneous unlocking of the guard is not entirely avoided because it is performed on a horizontal plane. This feature works as rotational extension of the side rail. The locking mechanism is constructed in such a way that the raised part at the top end of the guard engages the opening in the vertical support of the side rail. The lock is unlocked by the pin being released and moved through the cut of the collar located in the lower part of the guard. However, any of the described solution doesn't provide complete protection of spontaneous unlocking of the guard and its subsequent movement.

Document JP2003052764A describes a guard system with a limited movement. It consists of a rotational mechanism. The coupling is realized by a screw. The rotation is limited by a rectangle which is a part of the side rail and which is stopped by a protrusion which is part of the guard. This guard can be moved around a large range of its vertical axis of rotation, and parts of the upper limbs of patients or medical personnel can be then pinched here.

U.S. Pat. No. 6,058,531A describes another version of the locking mechanism where the guard rotates around the horizontal axis and where in each position at least a part of the patient support is covered by the guard against the patient falling out of bed. The movement of this guard is limited by a cut in a disk to which the guard is permanently fixed. This disk is rotationally attached to the bed frame.

JP2005334511A shows another solution. The guard consists of several parts which are mutually rotational around the vertical axis, always by a maximum of 90°. Part of the side rail rests against the ground via a rest. Unlocking is performed in the following manner: after rotating the lever it is possible to lift the rest and rotate the relevant number of parts of the guard to the required position in relation to the bed side rail, which at least one part of the guard is fixed to.

SUMMARY OF THE INVENTION

Bed (1) comprising a frame (3), patient support (4) and removable guard assembly (5) of the bed (1), the guard assembly (5) of the bed (1) includes the main support (7), which is provided at the lower end by a mounting for attaching to the bed (1), a guard (6) fixed to the main support (7) and a locking mechanism (13) for attaching the main support (7) to the bed (1). The locking mechanism (13) includes a sleeve (11) and a blocking member (19) which is within the guard assembly (5), the blocking member (19) actuatable by an actuator (10) and moveable between two positions, in the first position the blocking member (19) being located within the sleeve (11) and in the second position the blocking member (19) being located out of the sleeve (11), at least one of these positions defined by the position of the blocking member (19) as a locked position and a movement of the main support (7) with respect to the sleeve (11) is prevented.

The guard assembly, according to the invention, improves the ease of operation, in particular due to the simple control and cleanability. It also improves patient safety.

According to the preferable embodiment the locking mechanism (13) includes a flexible member (18) for securing the blocking member (19) in the locked position of the locking mechanism (13).

According to another preferable embodiment the main support (7) includes a lever mechanism (14) for operating of the locking mechanism (13).

According to another preferable embodiment the guard assembly (5) includes the actuator (10) for operating the locking mechanism (13). The actuator (10) is slidable along an axis of the main support (7) or is slidable in the direction that is perpendicular to the longitudinal axis of the main support (7) or the actuator (10) may be rotational. The actuator (10) can include a recess (23) where is placed a rotational member (24) for reducing the actuating force.

According to another preferable embodiment the main support (7) includes at least one protrusion. This protrusion fits into an opening (12) of the sleeve (11). The locking mechanism (13) and at least one protrusion (9) are discrepantly oriented in the horizontal or vertical plane. The direction of the movement of the blocking member (19) is perpendicular to the direction of the movement of the protrusion (9) from the opening (12) for disengaging the guard assembly (5) out of the sleeve (11).

According to another preferable embodiment the guard assembly (5) of the bed (1) is in the engaged position in identical plane as the side rail (8) of the bed (1).

BRIEF DESCRIPTION OF THE DRAWINGS

FIG. 8*a* shows the alternative solution with the movable element outside the main support in the unlocked position.

DETAILED DESCRIPTION OF THE DRAWINGS

Figure 1:
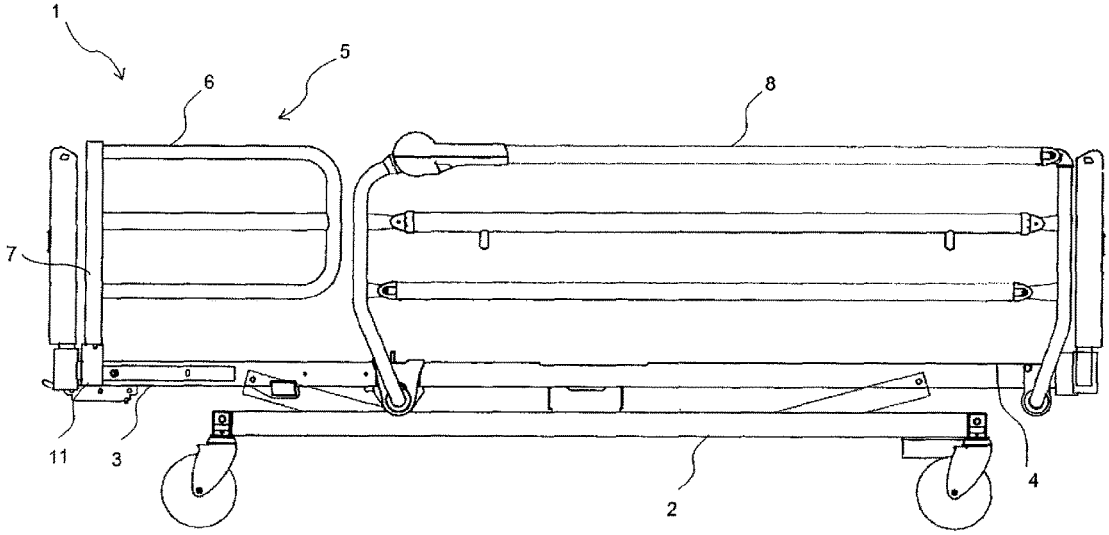
FIG. 1 shows the bed with the guard assembly according to the invention.
Figure 2:
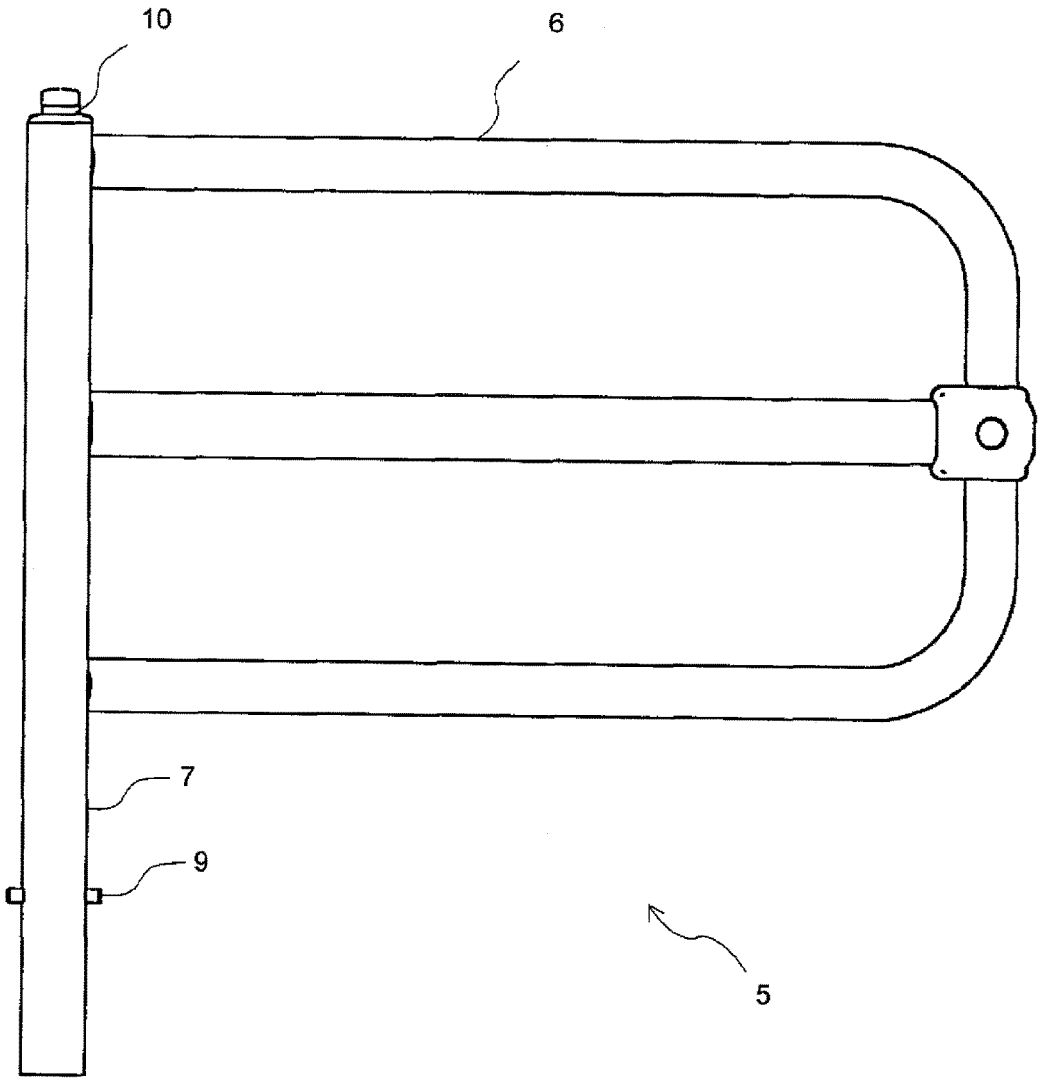
FIG. 2 shows the guard assembly.

FIG. 1 shows the bed 1 including the undercarriage 2, frame 3, patient support 4 and guard assembly 5. The guard assembly 5 includes the guard 6 and main support 7. The bed may contain at least one side rail 8. In FIG. 1 the guard 5 is inserted into the sleeve 11, which is located on the frame 3 of the bed 1. In the position in which the guard prevents the patient getting out of bed it also prevents the movement of the side rail 8 to collapsed position. FIG. 2 shows the guard assembly 5 without the bed. At the bottom end of the main support 7 there are the locking protrusions 9 which engage in the holes 12 of the sleeve 11, as can be seen in FIG. 3.

Figure 3:
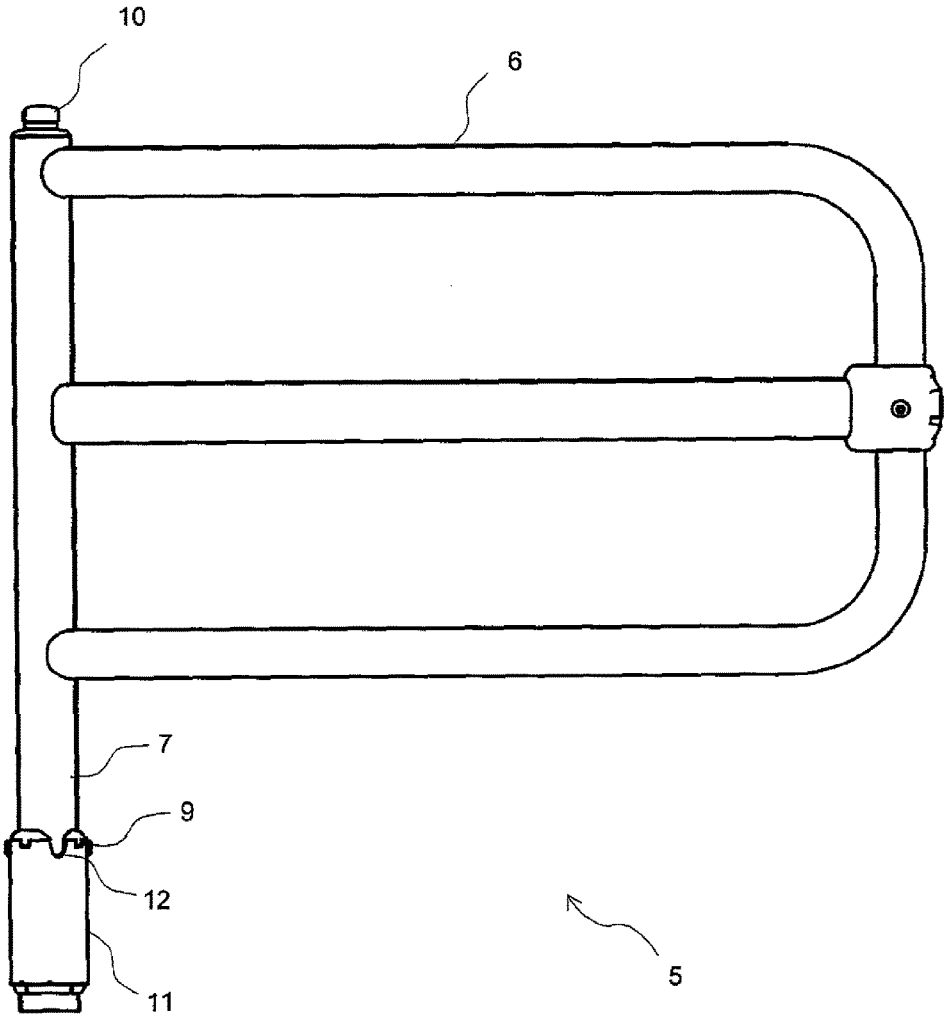
FIG. 3 shows the guard assembly in the sleeve.

FIG. 3 shows the guard assembly 5, guard 6 with sleeve 11 in the locked position. At its bottom end the main support 7 is provided with two protrusions 9 which engage in the holes 12 of the sleeve 11. The guard assembly 5 can be removed from the sleeve 11, so it can be removed from the bed 1. The guard assembly 5 includes two safety elements. The first safety element consists of the locking mechanism 13 as can be seen in FIGS. 5*b* and 6*b*. After unlocking of the locking mechanism 13 the design of the sleeve 11 allows the main support 7 to slide out. The sliding out of the main support 7 is used as the second safety element. Only after both safety elements have been overcome, it means after activation of the actuator 10 and sliding out of the guard assembly 5 it is possible to rotate the main support 7 around the axis of the main support 7 or the guard assembly 5 to be fully removed from the bed.

Figure 4:
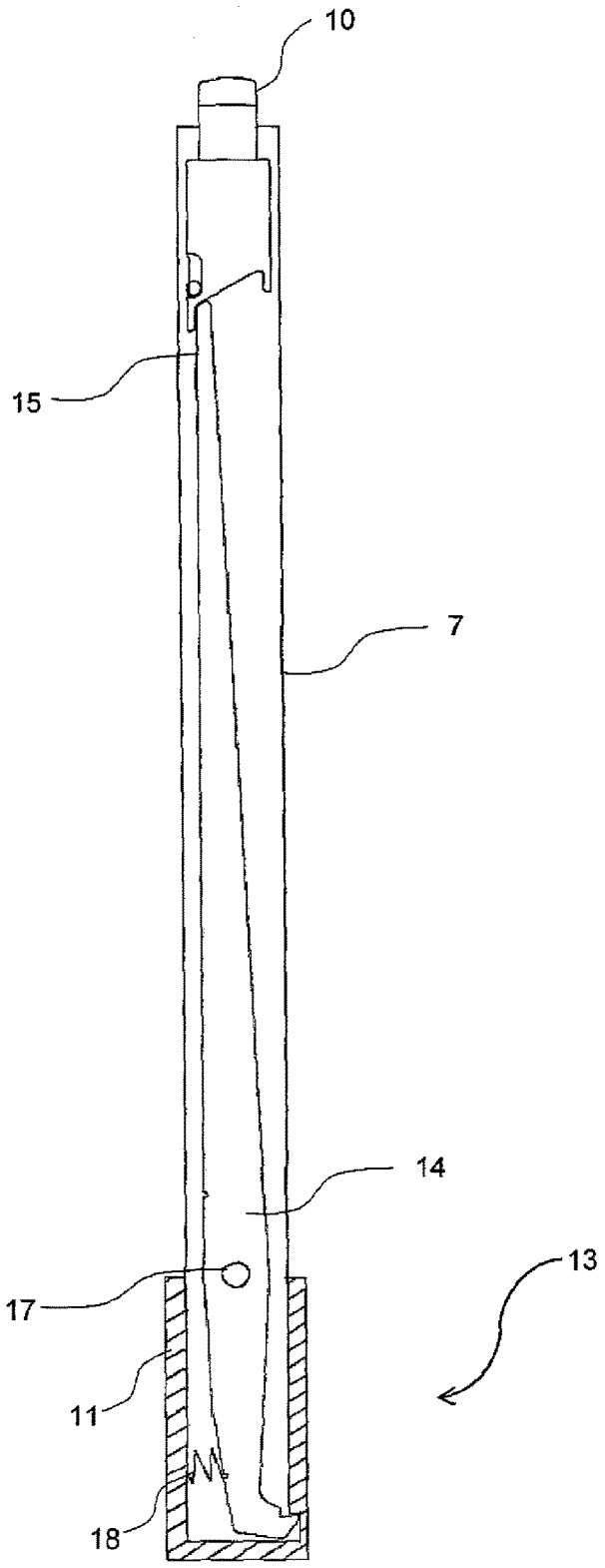
FIG. 4 shows the lever mechanism in the main support.

FIG. 4 shows the lever mechanism 14. The lever mechanism 14 is able to rotate around the axle 17 consisting of the line between the two protrusions 9 (not shown in this picture) located inside the main support 7. As it is visible in FIG. 5*a* the actuator 10 located inside the main support 7 is chamfered at its lower end. This chamfered end is in contact with the first end 15 of the lever mechanism 14. The movement of the actuator 10 deflects the first end 15 of the lever mechanism 14. The actuator 10 includes a recess 23 in which is placed the rotational element 24 for reducing the frictional forces and reducing the magnitude of the force necessary for movement of the actuator 10. The movement of the first end 15 of the lever mechanism 14 causes the movement of the second end 16 of the lever mechanism 14, which includes the blocking member 19 of the locking mechanism 13, as can be seen in FIG. 5*b*. The locking mechanism 13 engages through the slot 22 of the main support 7 to the recess 21 of the sleeve 11. The second end 16 of the lever mechanism 14 has a cog 20 which one end of the flexible member 18 is inserted in. The second end of the flexible member 18 is supported by the body of the main support 7. The flexible member 18 urges the lever mechanism 14 to return to the original locked position.

The locking mechanism 13 is shown in FIG. 5*b* and FIG. 6*b*. It consists of a blocking member 19 of the locking mechanism 13 located at the second end 16 of the lever mechanism 14 and a sleeve 11 fixed to the frame 3 of the bed 1. The blocking member 19 of the locking mechanism 13 can be moved between two positions. The sleeve 11 can be part of the frame 3 of the bed 1 (not in the figures), for example it may be an opening for an IV pole, etc.

Figure 5A:
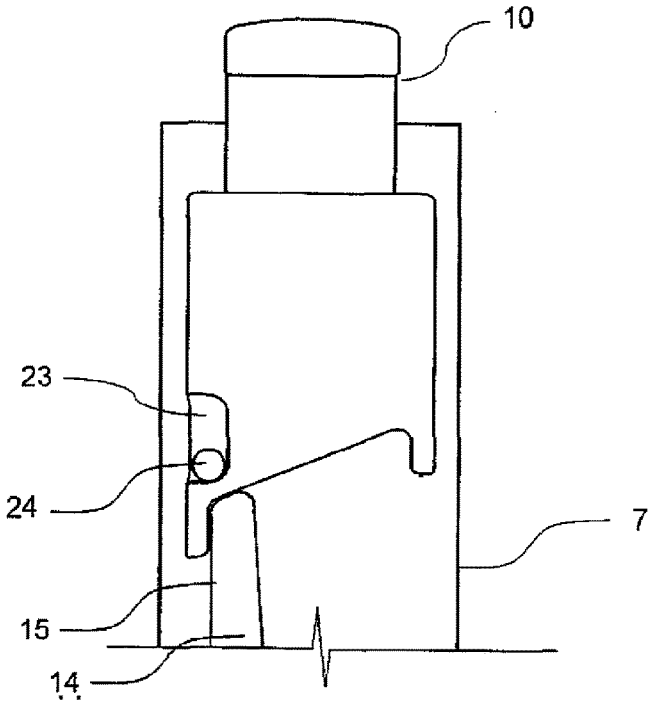
FIG. 5*a* shows a detail of the actuator in the locked position.
Figure 5B:
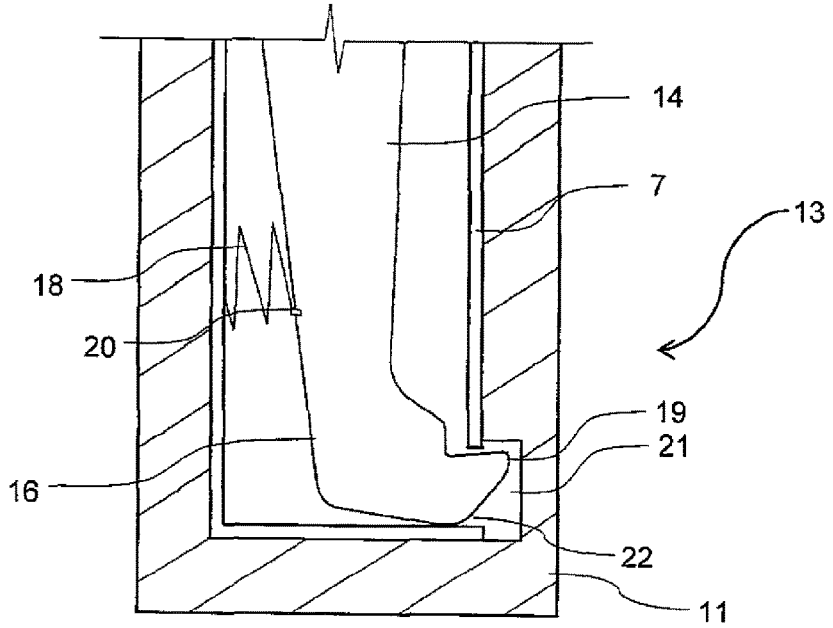
FIG. 5*b* shows a detail of the locking mechanism in the locked position.

FIGS. 5*a* and 5*b* show the first locked position, the movement of the main support 7 in relation to the sleeve 11 is blocked. In FIG. 5*a* the actuator 10 is higher than in the unlocked position (FIG. 6*a*), and the first end 15 of the lever mechanism 14 is in contact with the lower end of the actuator 10. FIG. 5*b* shows the locking mechanism 13 in the first locked position. Due to the force of the flexible member 18, the blocking member 19 of the locking mechanism 13 passes through the slot 22 of the main support 7 and engages in the recess 21 of the sleeve 11. The movement of the guard 6 is prevented by the locking mechanism 13. The second end 16 of the lever mechanism 14 includes a cog 20 for the placement of the flexible member 18.

Figure 6A:
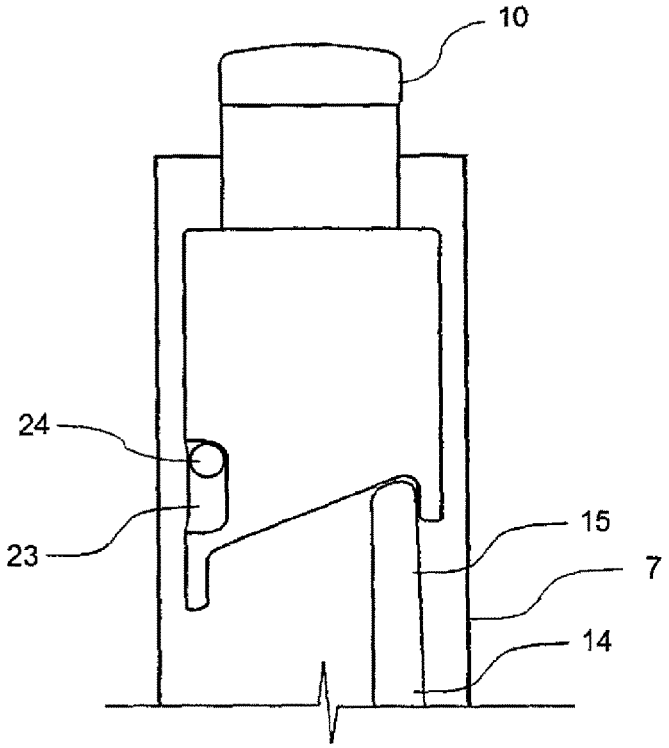
FIG. 6*a* shows a detail of the actuator in the unlocked position.
Figure 6B:
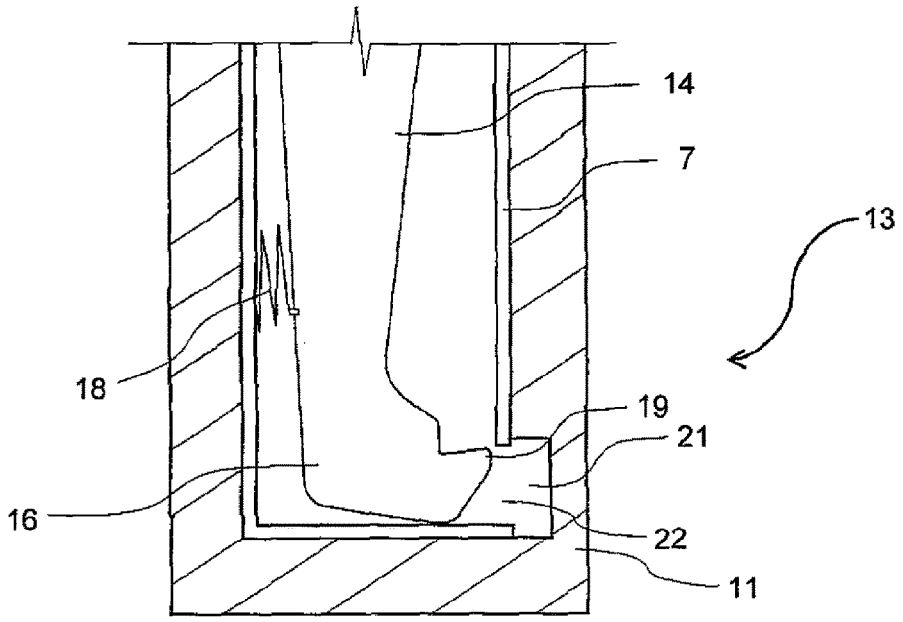
FIG. 6*b* shows a detail of the locking mechanism in the unlocked position.

The second unlocked position is shown in FIG. 6*a* and FIG. 6*b*. In FIG. 6*a* the actuator 10 is pressed and so the actuator 10 is in a lower position than in the locked one. The movement of the actuator 10 downwards causes sliding of the first end 15 of the lever mechanism 14 from the first side of the chamfered edge of the actuator 10 in the direction of the second side of the chamfered edge. The first end 15 of the lever mechanism 14 is then in contact with the second higher positioned end of the chamfered part of the actuator 10. In FIG. 6*b* the locking mechanism 13 is shown in the second unlocked position. The blocking member 19 of the locking mechanism 13 is extended against the force of the flexible member 18 into the main support 7 via the second end 16 of the lever mechanism 14. The movement of the main support 7 in relation to the sleeve 11 is possible in this position. The sleeve 11 may include several recesses 21 according to the number of locking positions. The actuator 10 should preferably be located at the upper end of the main support 7. But in an alternative version it may be located anywhere along its height or in the guard 6. The actuator 10 may be extendible, a button or a slider, or rotational (see alternative versions below).

Figure 7:
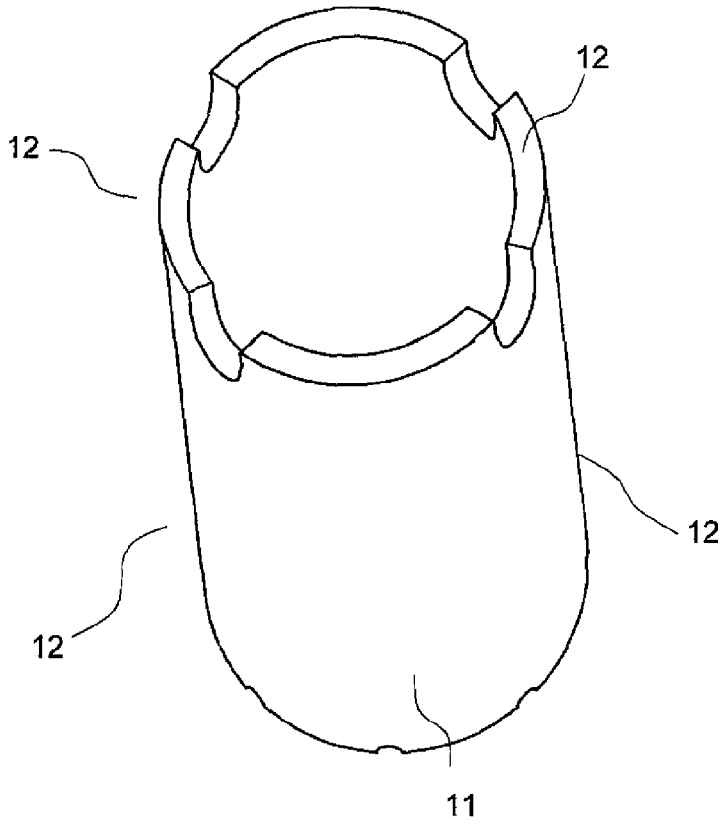
FIG. 7 shows a detail of the sleeve.

FIG. 7 shows the sleeve 11 for connecting the guard assembly 5 to the frame 3 of the bed 1. The sleeve 11 includes holes 12 which the protrusions 9 of the main support 7 are engaged in and which are also the second safety element. The sleeve 11 includes on the inner side recesses 21 (for example in FIG. 6*b*) in which the blocking member 19 of the locking mechanism 13 is engaged and thus constitute the first safety element.

Figure 8A:
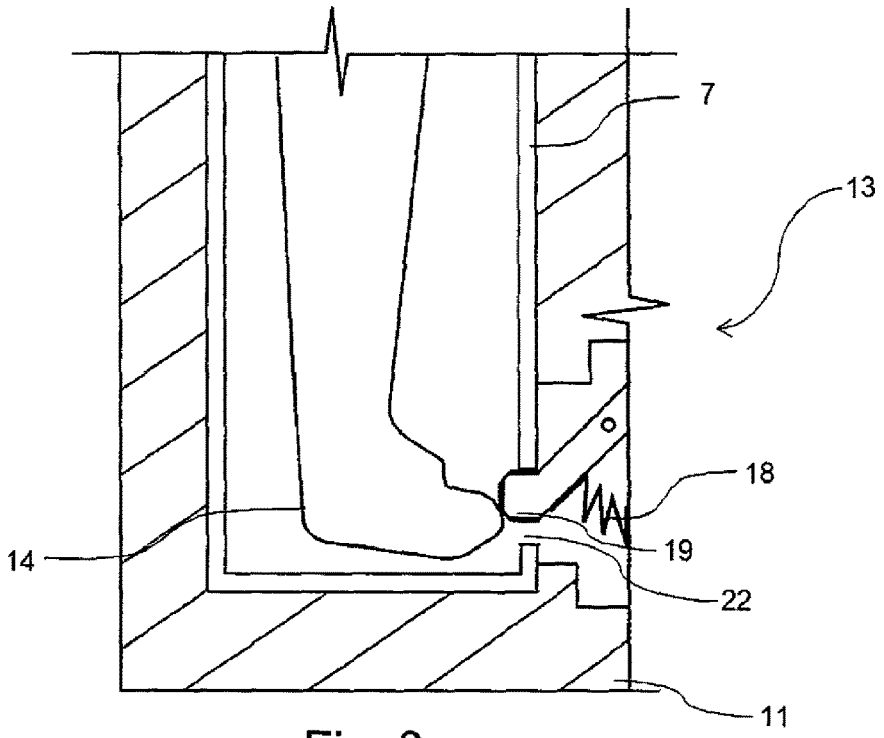
FIG. 8*a* shows the alternative solution with the movable element outside the main support in the locked position.
Figure 8B:
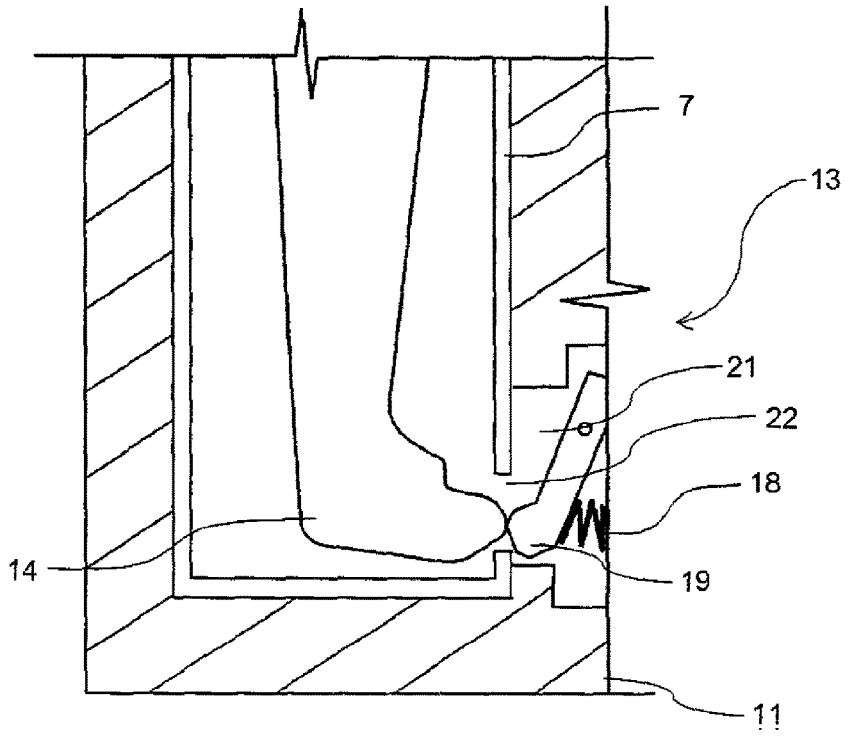

FIGS. 8*a* and 8*b* show other possible alternative embodiment where the blocking member 19 of the locking mechanism 13 is located in the sleeve 11 along with the flexible member 18. The blocking member 19 of the locking mechanism 13 may be in two positions. In the first locked position shown in FIG. 8*a* the blocking member 19 of the locking mechanism 13 engages the slot 22 of the main support 7 and prevents the movement of the main support 7 in relation to the sleeve 11. So in this position the blocking member 19 is released from the sleeve and the guard assembly 5 is locked. In the second position shown in FIG. 8*b* the blocking member 19 of the locking mechanism 13 is forced by the lever mechanism 14 against the flexible member 18. The lever mechanism 14 is located in the main support 7 and forces the blocking member 19 of the locking mechanism 13 from the slot 22 into the recess 21 in the sleeve 11. In the second position the guard assembly 5 is unlocked and the movement of the main support 7 in relation to the sleeve 11 is allowed. So in this position the blocking member 19 engages in the sleeve 11. In this embodiment the lever mechanism 14 can be replaced by a chamfered sliding element which forces out the blocking member 19 of the locking mechanism 13.

Figure 9A:
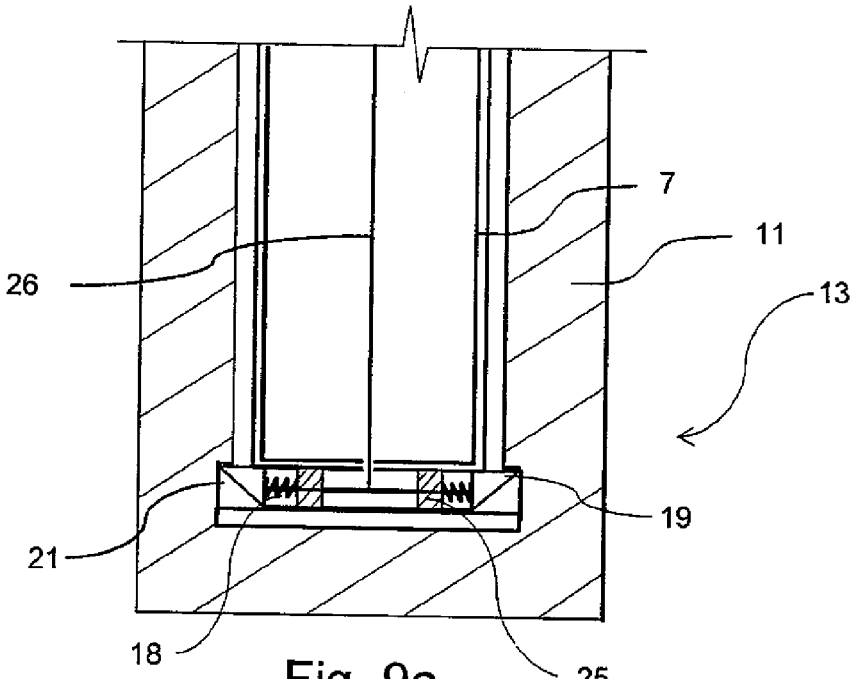
FIG. 9*a* shows the alternative solution with two movable elements in the locked position.
Figure 9B:
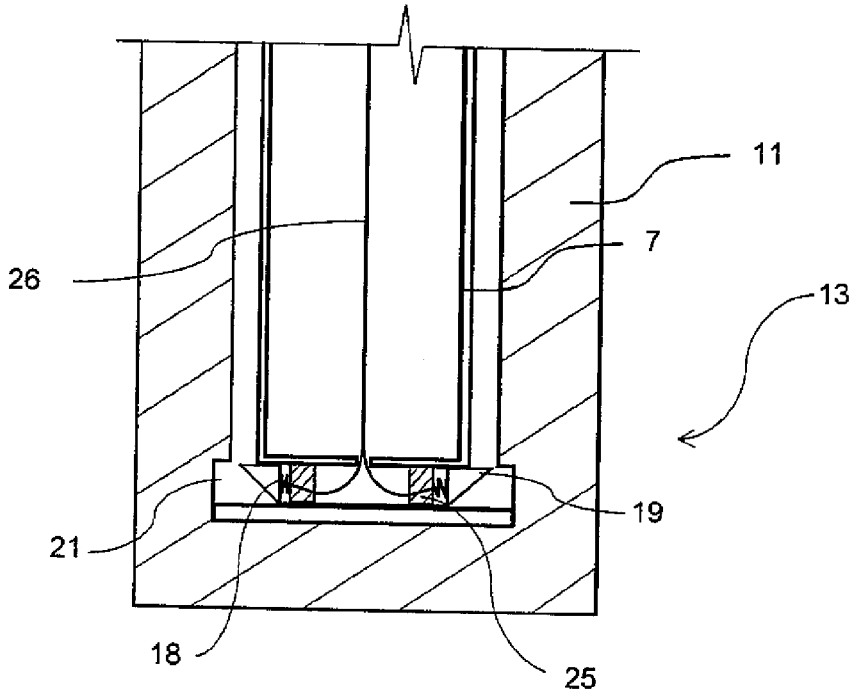
FIG. 9*b* shows the alternative solution with two movable elements in the unlocked position.

FIG. 9*a* and FIG. 9*b* show other alternative embodiment of the locking mechanism 13. In the locked position the blocking member 19 of the locking mechanism 13 engages in the recess 21 in the sleeve 11. The force of the flexible member 18 keeps the guard assembly 5 locked, and the movement of the guard assembly 5 is prevented. So in this position the blocking member 19 engages in the sleeve. This position is shown in FIG. 9*a*. FIG. 9*b* shows the unlocked position. In FIG. 9*b* the blocking member 19 is released from the sleeve. The tension member 26 running through the flexible member 18 draws the blocking member 19 of the locking mechanism 13 into the main support 7 against the force of the flexible member 18, which rest against the stops 25. This unblocks the first safety element, and the guard assembly 5 can move vertically.

Figure 10:
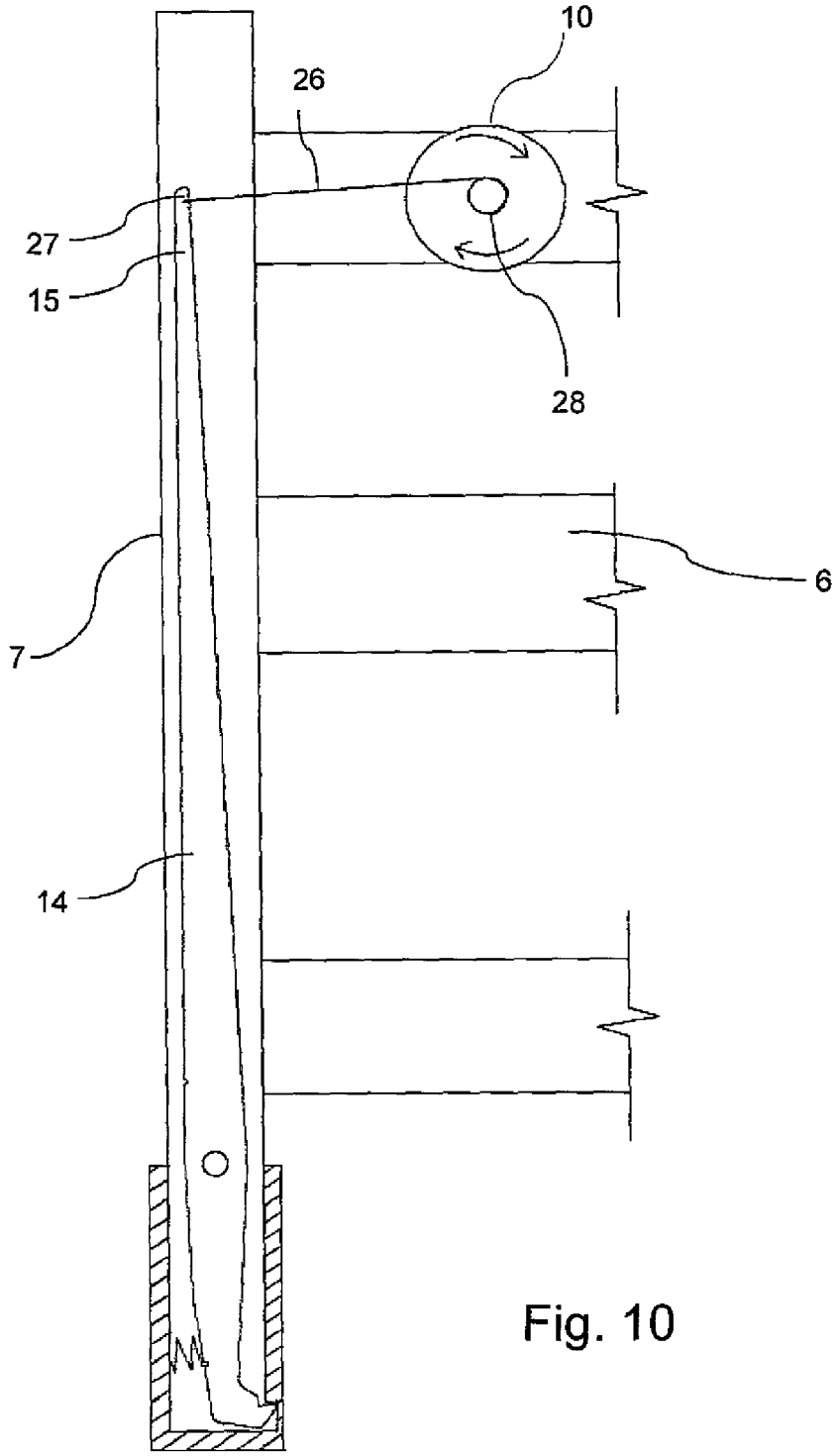
FIG. 10 shows the alternative solution of the actuator.

The execution of the rotational actuator 10 is shown in FIG. 10. The movement of the rotational actuator 10 is converted to a sliding movement of the tension element 26, the first end 27 of the tension element 26 is fixed to the first end 15 of the lever mechanism 14, and the second end 28 of the tension element 26 is fixed to the housing of the rotational actuator 10 in such a way that by rotation of the actuator 10 the tension element 26 is wound onto the actuator 10 and it thus causes the movement of the first end 15 of the lever mechanism 14. The rotational actuator 10 may be fixed directly to the first end 15 of the lever mechanism 14, so it may involve a solution without use of a tension element 26. The use of a slider instead of a rotational actuator 10 may be an alternative to this solution. The alternative with a slider may also work without the use of a tension element.

Both alternative versions of the actuators may be located anywhere on the guard. Other combinations of the individual solutions shown are also possible for the technical execution.

LIST OF REFERENCE NUMBERS

1 bed
2 undercarriage
3 frame
4 patient support
5 guard assembly
6 guard
7 main support
8 side rail
9 protrusion
10 actuator
11 sleeve
12 opening
13 locking mechanism
14 lever mechanism
15 first end of the lever mechanism
16 second end of the lever mechanism
17 axis of rotation
18 flexible member
19 blocking member
20 tooth
21 recess
22 slot
23 recess
24 rotational member
25 stop
26 tension element
27 first end of tension element
28 second end of tension element

The invention claimed is:

1. Bed comprising a frame, a patient support, and a detachable guard assembly of the bed, the guard assembly of the bed comprising:

a main support, which is provided at a lower end of the guard assembly by a mounting for attaching to the bed, a guard fixed to the main support, and a locking mechanism for attaching the main support to the bed, wherein the locking mechanism includes a sleeve and a blocking member which is within the guard assembly, the blocking member controllable by an actuator and moveable between two positions, in a first position, the blocking member engages the sleeve and in a second position, the blocking member disengages the sleeve, at least one of these positions defined by the position of the blocking member as a locked position wherein a movement of the main support with respect to the sleeve is prevented, and wherein the actuator is located at an upper end of the main support.

2. The detachable guard assembly of the bed according to claim 1, wherein the locking mechanism includes a flexible member for securing the blocking member in the locked position of the locking mechanism.

3. The detachable guard assembly of the bed according to claim 1, wherein the main support includes a lever mechanism for operating the locking mechanism.

4. The detachable guard assembly of the bed according to claim 1, wherein the actuator operates the locking mechanism.

5. The detachable guard assembly of the bed according to claim 4, wherein the actuator is slidable along an axis of the main support.

6. The detachable guard assembly of the bed according to claim 4, wherein the actuator is slidable in a direction that is perpendicular to a longitudinal axis of the main support.

7. The detachable guard assembly of the bed according to claim 4, wherein the actuator is rotational.

8. The detachable guard assembly of the bed according to claim 4, wherein the actuator includes a recess in which is placed a rotational member for reducing actuating force.

9. The detachable guard assembly of the bed according to claim 1, wherein the main support includes at least one protrusion.

10. The detachable guard assembly of the bed according to claim 9, wherein the at least one protrusion fits into an opening of the sleeve.

11. The detachable guard assembly of the bed according to claim 9, wherein the blocking member moves in a direction that is perpendicular to a direction of movement of the at least one protrusion from the opening for disengaging the guard assembly out of the sleeve.

12. The detachable guard assembly of the bed according to claim 1, wherein the guard assembly of the bed is in an engaged position in an identical plane as a side rail of the bed.

13. Bed comprising a frame, a patient support, and a detachable guard assembly of the bed, the guard assembly of the bed comprising:

a main support, which is provided at a lower end of the guard assembly by a mounting for attaching to the bed, a guard fixed to the main support, and a locking mechanism for attaching the main support to the bed, wherein the locking mechanism includes a sleeve and a blocking member which is within the guard assembly, the blocking member controllable by an actuator and moveable between two positions, in a first position, the blocking member engages the sleeve and in a second position, the blocking member disengages the sleeve, at least one of these positions defined by the position of the blocking member as a locked position wherein a movement of the main support with respect to the sleeve is prevented, and wherein the actuator is located at an upper end of the main support and the blocking member is located at a lower end of the main support, and wherein the guard assembly is completely detachable.

* * * * *